US005141149A

United States Patent [19]

Fulton

[11] Patent Number: 5,141,149

[45] Date of Patent: Aug. 25, 1992

[54] MULTIPLE USE PLANT SHIPPING AND DISPLAY CONTAINER

[76] Inventor: J. Scott Fulton, 2811 21st St., Boulder, Colo. 80304

[21] Appl. No.: 740,070

[22] Filed: Aug. 5, 1991

[51] Int. Cl.[5] ..... B65D 5/54

[52] U.S. Cl. ..... 229/103; 47/84; 47/901; 206/423; 229/915; 229/DIG. 11

[58] Field of Search ..... 229/103, 101.2, 120.011, 229/915, DIG. 11, 120.17; 206/45.11, 423; 47/84, 901

[56] References Cited

U.S. PATENT DOCUMENTS

| | | | |
|---|---|---|---|
| 1,670,498 | 10/1928 | Einson . | |
| 2,118,821 | 5/1938 | Ringler | 229/103 |
| 2,315,999 | 4/1943 | Holm | 206/45.11 |
| 2,721,022 | 10/1955 | Billerbeck | 206/423 |
| 2,998,909 | 9/1961 | Anderson, Jr. et al. | 229/120.011 |
| 3,379,304 | 7/1968 | Mertz . | |
| 3,606,004 | 7/1971 | Fruehwirth . | |
| 3,660,934 | 3/1972 | Pollack et al. | 57/34.11 |
| 4,084,740 | 4/1978 | Lorenz | 229/915 |
| 4,170,301 | 7/1979 | Jones et al. | 206/423 |
| 4,184,595 | 1/1980 | Wackerman | 206/423 |
| 4,245,773 | 4/1981 | Stollberg . | |
| 4,330,059 | 4/1982 | Freeman | 206/423 |
| 4,335,843 | 2/1982 | Kent . | |

FOREIGN PATENT DOCUMENTS

| | | | |
|---|---|---|---|
| 344652 | 12/1989 | European Pat. Off. | 229/915 |
| 8101464 | 10/1982 | Netherlands | 206/423 |
| 1379947 | 1/1975 | United Kingdom | 229/120.17 |

*Primary Examiner*—Gary E. Elkins
*Attorney, Agent, or Firm*—Bruce E. Dahl

[57] ABSTRACT

A multiple use packaging and shipping container for plants includes two opposed vertical side trays separated by a horizontal floor. Flats of bedding plants placed on the horizontal floor extend into the two opposed vertical side trays, which hold the flats and prevent them from moving. The opposed vertical side trays will support several additional shipping and display containers, allowing them to be stacked, one on top of another, without crushing or damaging the plants. The sides may also include vertical top tabs and bottom slots for aligning and holding the shipping and display containers in position when they stacked one on top of the other. Once delivered, these containers may be displayed in the stacked configuration, or may be unstacked. Each side tray of the container may be separated from the floor and reconfigured into a customer carry-out tray.

9 Claims, 3 Drawing Sheets

MULTIPLE USE PLANT SHIPPING AND DISPLAY CONTAINER

BACKGROUND OF THE INVENTION

1. FIELD OF THE INVENTION

The present invention relates to containers used in the transportation and storage of horticultural or agricultural goods and more specifically to a dual configuration shipping and display container for bedding plants and other nursery stock.

2. DESCRIPTION OF THE PRIOR ART

The distribution path of bedding plants, small woody plants, potted plants, and other nursery stock begins at the grower. When the "flats" of plants are ready for sale, they are usually loaded onto large metal racks which are then placed into trucks and transported to garden supply stores or other retail outlets. Once at the retail outlet, the plants are usually unloaded from the truck and put on display in the same racks in which they were shipped. Occasionally, however, the plants may also be unloaded from the shipping racks and placed onto separate display racks for display and sale. The retailer may also provide separate customer carry-out containers to aid the customers in carrying home their selected flats of plants. Therefore, up to three separate transportation containers, be they shipping or display racks or customer carry-out containers, may be used to facilitate transport or display of the plants at various times, increasing the overall cost of the plants.

Over the years, various types and configurations of paperboard or corrugated paperboard shipping containers have been developed in attempts to reduce the reliance on expensive and inconvenient metal shipping and display racks. Examples of such paperboard shipping containers for plants are shown in U.S. Pat. No. 3,379,304, issued Apr. 23, 1968 to Mertz; U.S. Pat. No. 3,606,004, issued Sept. 20, 1971 to Fruehwirth; U.S. Pat. No. 4,170,301, issued Oct. 9, 1979 to Jones et al ; and, U.S. Pat. No. 4,330,059, issued May 18, 1982 to Freeman.

Unfortunately, these paperboard containers have not proven to be a panacea, and there remain a number of problems with such paperboard shipping containers. For example, such containers typically designed only for shipping nursery stock from the grower to the retailer, and are not well-suited for display or eventual customer carry-out of the plants. Such containers are little more than fully enclosed cardboard boxes, and are relatively dark, cramped, and provide little air circulation into or around the nursery stock or plants being shipped therein, which can cause wilting or other damage to the plants. Another disadvantage associated with such prior art paperboard shipping containers is that they are usually relatively difficult, thus expensive, to assemble and often require staples, glue, or tape to help hold them together. Still other containers, such as the container disclosed in the Mertz patent, require special jigs or forms for assembly.

Despite the development of these seemingly convenient paperboard shipping containers, it is still common to ship the plants contained within such containers in metal racks, because the paperboard containers are usually not strong enough to allow several containers to be directly stacked on top of one another. As mentioned above, besides being costly, these shipping racks are cumbersome and must be "dead headed" or returned empty to the grower before they can be used again, which results in substantial return shipping costs.

Therefore, there remains a need to provide a shipping container for flats of nursery plants and the like that provides a suitable environment for the plants during shipping and which can be easily stacked for shipment on trucks without requiring the expensive and cumbersome metal shipping racks. Moreover, such a container should be suitable for displaying the plants at the retail outlet to completely eliminate the need for expensive and cumbersome shipping or display racks. Ideally, such a container also should be readily and easily convertible into a customer carry-out container, thereby eliminating the need for the retailer to supply separate customer carry-out containers. Until the present invention, no such container existed.

SUMMARY OF THE INVENTION

Accordingly, it is a general object of the present invention to provide a multiple use plant container which may be used for shipping and displaying the plants, and which may be readily converted into a convenient customer carry-out tray.

It is another general object of the present invention to provide a means for shipping and displaying nursery plants and the like that does not require separate shipping or display racks.

It is a further object of this invention to provide a multiple use container for plants that is stackable, while at the same time providing a high degree of ventilation and illumination for the plants inside.

It is still a further object of the present invention to provide a multiple use container that is easy to assemble and that does not require the use of staples, glue, or tape.

Additional objects, advantages, and novel features of the invention shall be set forth in part in the description that follows, and in part will become apparent to those skilled in the art upon examination of the following or may be learned by the practice of the invention. The objects and the advantages of the invention may be realized and attained by means of the instrumentalities and in combinations particularly pointed out in the appended claims.

To achieve the foregoing and other objects and in accordance with the purpose of the present invention, as embodied and broadly described herein, the multiple use plant shipping and display container according to this invention includes two opposed vertical side trays separated by a horizontal base or floor. Flats of bedding plants placed on the horizontal base or floor extend into the two opposed vertical side trays, which hold the flats and prevent them from moving. The opposed vertical side trays will support several additional shipping and display containers, allowing them to be stacked, one on top of another, without crushing or damaging the plants. These vertical side trays may also include vertical top tabs and bottom slots for aligning and holding the shipping and display containers in position when they stacked one on top of the other. Optionally, these stacked containers may be bound together and reinforced with corner strips and top and bottom pieces to provide additional structural support and stability during the shipping process. Finally, each side tray of the container may be separated from the floor and reconfigured into a customer carry-out tray.

BRIEF DESCRIPTION OF THE DRAWINGS

The accompanying drawings, which are incorporated herein and form a part of the specification illustrate preferred embodiments of the present invention, and together with the description, serve to explain the principles of the invention. In the drawings.

DETAILED DESCRIPTION OF THE PREFERRED EMBODIMENT

Figure 1:
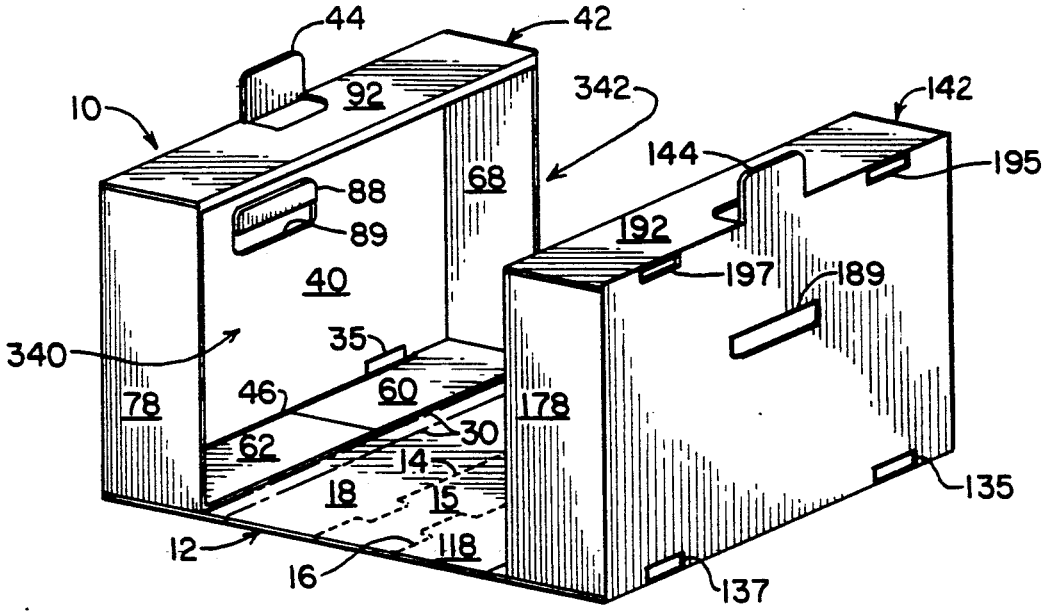
FIG. 1 is a perspective view of the multiple use plant shipping and display container showing the container in its shipping and display configuration.
Figure 4:
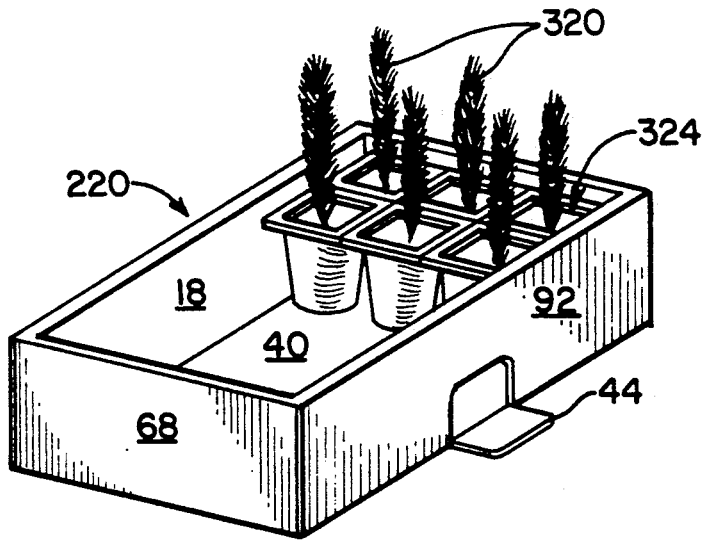
FIG. 4 is perspective view of one of the vertical side trays reconfigured to provide a convenient customer carry-out tray.

The multiple use plant shipping and display container 10 according to the present invention is shown in FIG. 1 assembled in the shipping and display configuration. In this configuration, the container 10 is ideally suited to ship and display flats of nursery plants. Advantageously, the container 10 can be readily and easily converted into a customer carry-out tray 220, as shown in FIG. 4 and as will be described below. Optionally, this tray configuration 220 could provide an alternate means for displaying the flats of plants.

In the shipping and display configuration shown in FIG. 1, the container 10 comprises two opposed vertical side trays 42 and 142 that are attached to either end of an elongated base or floor section 12. Each vertical side tray 42, 142 includes an upwardly extending tab 44, 144, respectively, for engaging corresponding slots 46 and 146 on the bottom of vertical side trays 42, 142, to help align and hold the containers when they are stacked together (FIGS. 2 and 5), as will be described in detail below. Finally, each vertical side tray 42, 142 also includes a suitable hand hold 89, 189, respectively, to allow individual or stacked containers to be easily moved from place to place.

As described above, several containers 10 may be stacked and bound together for ease of handling during shipping. In the preferred embodiment, four (4) such containers can be stacked and bound together with straps 260 and 262, preferably including an additional top piece 250 and bottom piece 251 and corner reinforcements 252, 254, 256, 258, as shown in FIG. 3. Note that corner reinforcement 252 is for the rear corner and cannot be seen in FIG. 3. After the bedding plants have arrived at the retail outlet, the straps 260, 262, top piece 250, bottom piece 251, and corner reinforcements 252, 254, 256, 258 can be removed and discarded and the containers 10 may be used to display bedding plants 320. Depending upon the arrangement or configuration of a given display area, it may be more convenient to arrange the containers 10 into shorter stacks, as shown in FIG. 2, or into single units, as shown in FIG. 1.

Finally, as the plants are gradually sold off, the containers 10 can be easily and quickly re-configured into customer carry-out trays 220, as shown in FIG. 4. Since each such customer carry-out tray 220 is made from a single vertical side tray, such as vertical side tray 42, each container 10 in the shipping and display configuration will yield two customer carry-out trays 220. Each container 10 is re-configured into two carry-out trays 220 by separating the floor 12 of container 10 into two halves at perforations 14 and 16, and folding bottom side doubler panels 18 and 118 into the sides 42 and 142, respectively, as will be described in greater detail below. The multiple use plant shipping and display container 10 is therefore suitable for the transportation, display, and customer carry-out of a wide variety of horticultural and agricultural products, including potted plants, small woody plants, bedding plants, and other nursery stock, and does not require the use of expensive and inconvenient metal racks for shipping or display.

Besides providing convenient carry-out trays 220 for retail customers, side tray 42 and 142 provide sufficient strength when in the shipping and display configuration to allow several such containers to be stacked on top of each other without damaging the delicate plants 320 within. Furthermore the sides 42 and 142 allow the spaces 340 and 342 between side trays 42 and 142 to remain open when the containers are stacked together to allow air and light to easily reach the bedding plants 320 to help prevent the plants 320 from wilting or dying during shipping.

Figure 2:
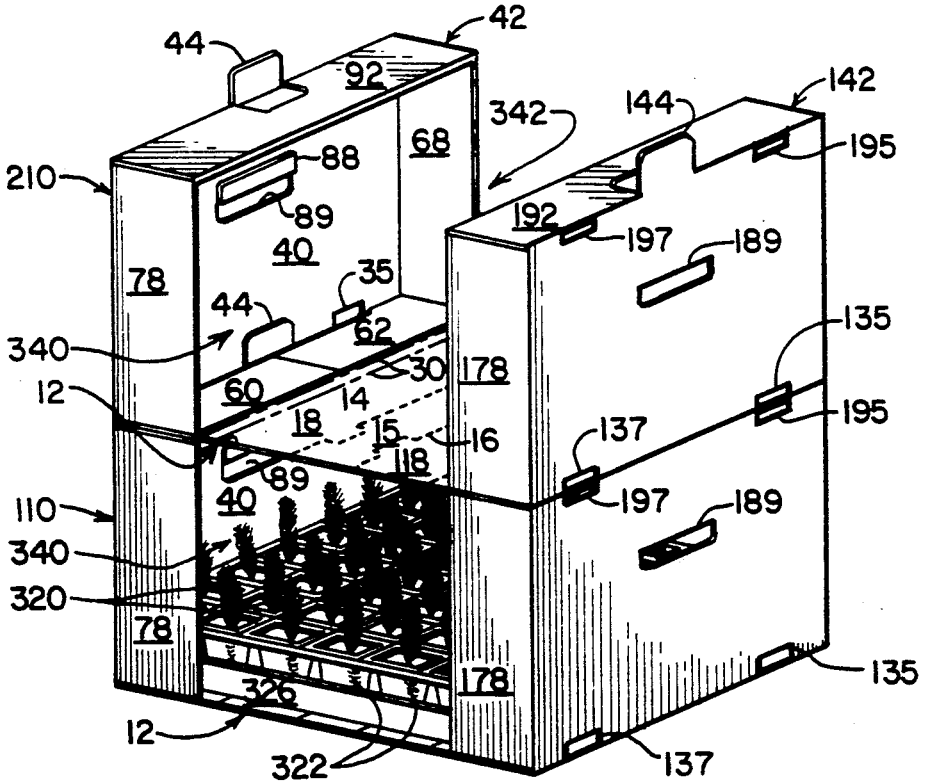
FIG. 2 is a perspective view of two of the multiple use containers of the present invention in the shipping and display configuration, showing the stacking alignment of the containers and how flats of bedding plants are contained therein and held by the vertical side trays.
Figure 3:
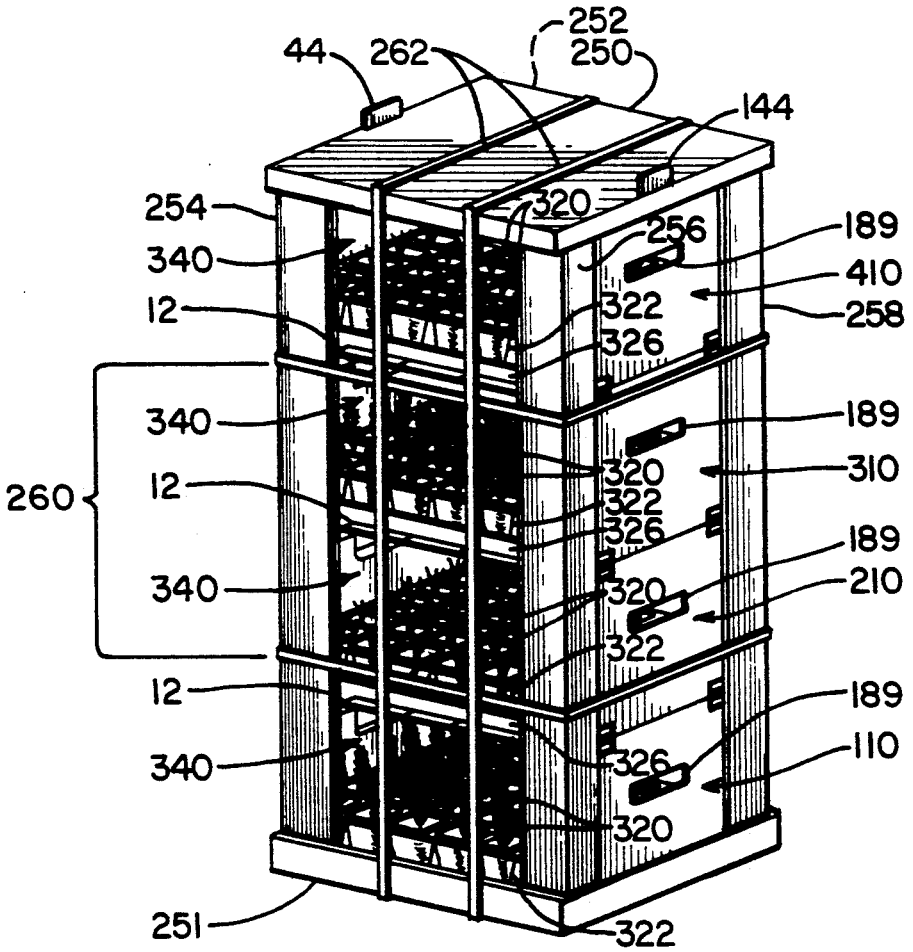
FIG. 3 is a perspective view of a stack of four multiple use containers of the present invention strapped together with optional corner reinforcements and top piece.

FIGS. 2, 3, and 4 show containers 10 and customer carry-out tray 220 used in association with bedding plants 320. Typically, such bedding plants 320 are grown, shipped, and sold in plastic or pressed paper pots 322, which may be arranged in groups of six to form a "flat" 324, as seen in FIG. 4. A large tray 326 may be optionally used to conveniently carry a number of individual pots 322 or, more commonly, to carry and organize several flats 324. A typical tray 326 will hold an array of 6 flats; three wide by two deep. Although container 10 may be made to any size desirable for given purpose, the preferred embodiment is sized so that a single tray 326, with its thirty-six pots 322 or six flats 324, of six bedding plants 320 each, just fits within container 10, extending along the full length of bottom 12 and between the side trays 42 and 142, as best seen in FIG. 2. It is preferred, though not required, that the sides 42, 142 are high enough so that when they are re-configured or converted into customer carry-out trays 220 they are sufficiently wide to conveniently hold three pots 322 or a flat 324, across the width of the tray, as seen in FIG. 4. With such dimensional configurations, the container 10 will hold thirty six pots 322, or six flats 324, and each individual carry-out tray will hold eighteen pots 322 or three flats 324. In this manner, all the plants in a single shipping and display container 10 can be carried by the two carry-out trays derived therefrom.

Figure 5:
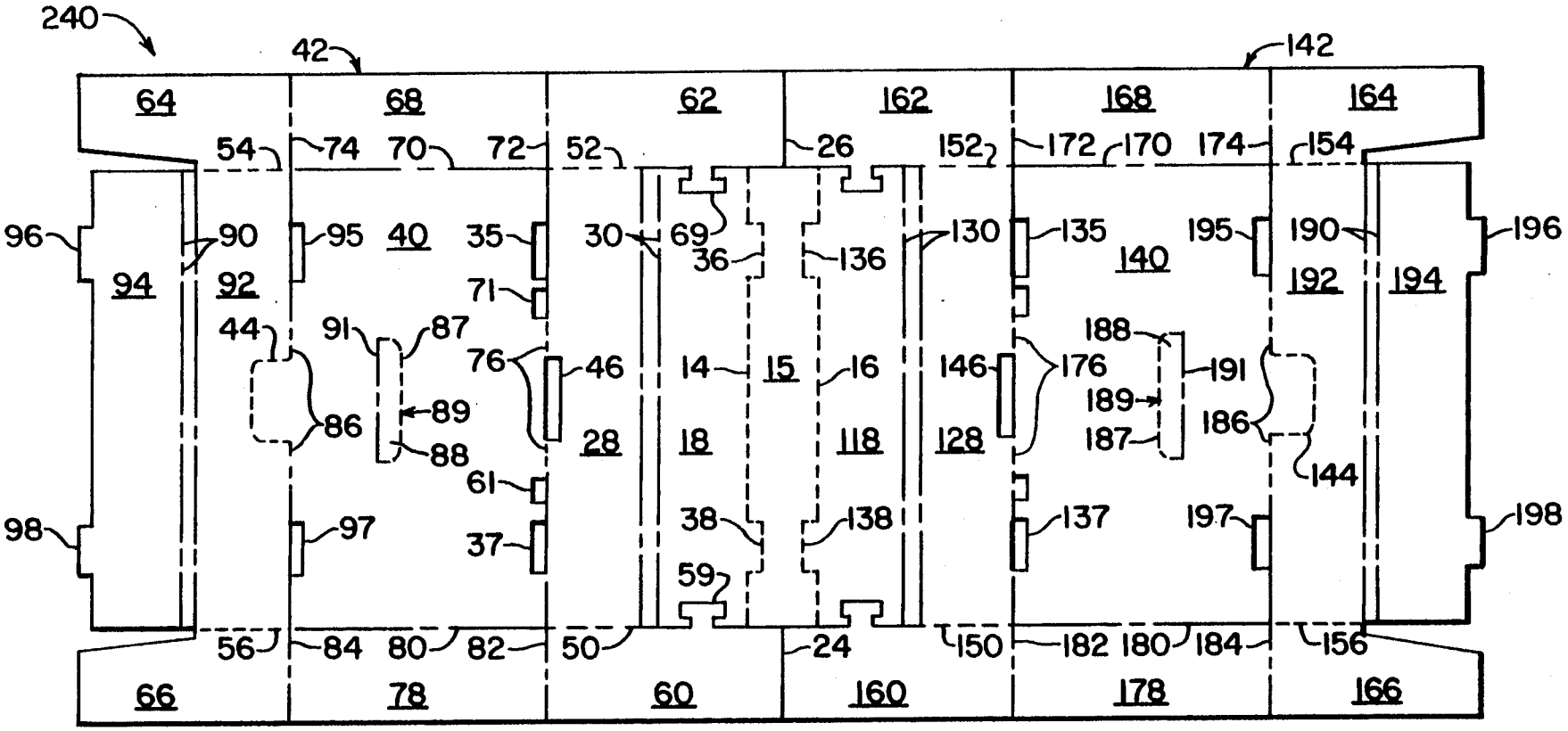
FIG. 5 is a top view of a one-piece die cut blank of the multiple use container of the present invention prior to assembly.

In the preferred embodiment, the container 10 is made from a single-piece blank 240, which has been cut, perforated, and scored as shown in FIG. 5. Blank 240 may be manufactured from any suitable rigid but foldable material such double wall or triple wall corrugated paperboard, or solid-fiber paperboard. Because such containers 10 are often subjected to moisture, it is preferred that the blank 240 be waxed or otherwise treated to repel water. Methods of impregnating paperboard with wax are well-known in the industry, and are not described in further detail.

Referring now to FIG. 5, the solid lines within the perimeter of blank 240 indicate cuts all the way through the material; short dashed lines indicate perforations in the blank material to assist in separating pieces; and the phantom lines indicate creases in the blank material to assist in folding blank 240 into container 10 or later into customer carry-out tray 220.

Folding or assembling blank 240 into shipping container 10 involves first assembling side trays 42 and 142. The first step in assembling side tray 42 is to separate bottom side wall engaging flap 62 from bottom side wall engaging flap 162 by separating cut 26, and by separating bottom side wall engaging flap 60 from bottom side wall engaging flap 160 by separating cut 24. Next, separating perforations 50, 52, 54, and 56 will free bottom side wall engaging flaps 60, 62, and top side wall engaging flaps 64, 66 respectively. Once freed, flaps 60, 62, 64, and 66 are folded upward from the drawing along scored lines 72, 74, 82, and 84, respectively. End walls 68, 78 are then folded upward and inward toward face 40 along scored lines 70 and 80, respectively, so that they are perpendicular to side panel 40. Such folding of the end walls 68 and 78 brings the ends of top side wall engaging flaps 64 and 66 together along the edge of side panel 40, near tab 44, and brings the ends of bottom side wall engaging flaps 60 and 62 together at the other edge of side panel 40. Bottom side wall engaging flaps 60 and 62 may be optionally fitted with locking tongues 59 and 69, respectively, in which case the folding of end walls 68 and 78 will bring tongues 59 and 69 into engagement with corresponding slots 61 and 71 in side panel 40. This tongue and slot engagement helps secure end walls 68 and 78 and prevents them from pulling out away from side panel 40 (i.e., forming an obtuse angle between either side wall 68 or 78, and side panel 40). If this tongue and slot engagement is not adapted, bottom side wall engaging flaps 60 and 62 may be optionally stapled, glued, or taped together to provide additional resistance to such pulling out. However, bottom side wall engaging flaps 60 and 62 are usually sufficiently secured by the weight of flat tray 326 in the container, and may not require such a tongue and slot configuration.

Side panel 40 is then made perpendicular to bottom 12 by folding along crease line 76, bringing bottom side wall engaging flaps 60 and 62 into contact with bottom 12 at section 28, as best seen in FIG. 1. The top side wall of side tray 42 is then completed by folding the top side wall piece 92 and top side wall chamber piece 94 around top side wall engaging flaps 64 and 66. This is done by first folding top side wall piece 92 along crease line 86 (insuring that upwardly extending tab 44 is punched out along its perforated line and left to remain as a parallel extension of side wall 40) and folding top side wall doubler piece 94 along crease line 90 and around top side wall engaging flaps 64, 66. Top side wall doubler piece 94 is then secured by inserting paired tabs 96, 98 into their respective paired slots 95, 97. Side tray 42 may include an optional hand hold 89 formed by separating flap 88 from side panel 40 at perforation line 87 and folding it inward or outward along crease line 91.

Side tray 142 is assembled in a manner similar to the above described side tray 42. Including separating bottom side wall engaging flaps 160, 162, and top side wall engaging flaps 164, 166 at perforations 150, 152, 154, and 156, and folding them along crease lines 172, 174, 182, and 184, respectively. End walls 168, 178 are then folded along crease lines 170, 180. Finally, top side wall engaging flaps 164, 166 are enclosed by top side wall piece 192 and top side wall doubler piece 194 and secured by inserting tabs 196, 198 into slots 195, 197.

Advantageously, each container 10 can be easily and quickly assembled without having to resort to staples, glue, or tape. Assembly or reconfiguration of the shipping and display container 10 into two convenient customer carry-out trays 220 is equally quick and easy and is also accomplished without the need for staples, glue, or tape.

Conversion of container 10 from the shipping and display configuration into two carry-out trays 220 will be described for the side tray 42 only, since the conversion process is identical for the side tray 142. The first step in converting the container 10 into the trays 220 is to separate the floor 12 of container 10 into two halves at perforations 14 and 16. The remaining center piece 15 is then removed and may be discarded. Next, the bottom side wall double piece 18 is brought around to enclose bottom side wall engaging flaps 60, 62 by folding it along crease lines 30 and is secured by inserting tabs 36 and 38 into slots 35 and 37, respectively. Accordingly, side tray 42 of container 10 has been conveniently converted into customer carry-out tray 220. Hand hold piece 88 may be reinserted into hole 89 in order to provide a flat bottom to tray 220.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention as defined by the claims which follow.

The embodiments of the invention in which an exclusive property or privilege is claimed are defined as follows:

1. A foldable blank of paperboard material having a plurality of foldably connected panels for erecting a multiple use shipping and display container, comprising:

a floor panel;

a pair of side panels disposed on opposite ends of said floor panel for forming opposed sides;

a pair of side end panels extending from opposed sides of each of said side panels for forming side end walls of each of said side panels;

a top side wall panel extending from each of said side panels for forming a top side wall of each of said side panels;

a pair of top side wall engaging flaps extending from opposite ends of said top side wall panel, one each of said top side wall engaging flaps also being foldably connected to one each of said end panels for reinforcing said top side wall panel; and a pair of bottom side wall engaging flaps, one each of which said bottom side wall engaging flap is foldably connected to one each of said end panels opposite the end foldably connected to each of said top side wall engaging flaps.

2. The foldable blank of claim 1 wherein each of said bottom side wall engaging flaps has a locking tongue and each of said side panels has a slot adapted to receive said locking tongue, whereby said tongues engage said slots when said bottom side wall engaging flaps are folded together.

3. A multiple use shipping and display container, comprising:

a first vertical side tray having a first vertical side panel with a first top side wall connected to the top side of said first vertical side panel, a first bottom side wall connected to the bottom side of said first vertical side panel, and a first pair of end walls connected to the ends of said first vertical side panel, each of said first pair of end walls also including a top side wall engaging flap and a bottom side wall engaging flap connected to the respective ends of said first pair of end walls, wherein said first top side wall includes a first top side wall piece and a first top side wall doubler piece connected to said first top side wall piece, said first top side wall doubler piece being folded around each of said top side wall engaging flaps, and wherein said first bottom side wall includes a first bottom side wall piece and a first bottom side wall doubler piece connected to said first bottom side wall piece;

a second vertical side tray having a second vertical side panel with a second top side wall connected to the top side of said second vertical side panel, a second bottom side wall connected to the bottom side of said second vertical side panel, and a second pair of end walls connected to the ends of said second vertical side panel, each of said second pair end walls also including a top side wall engaging flap and a bottom side wall engaging flap connected to the respective ends of said second pair of end walls, wherein said second top side wall includes a second top side wall piece and a second top side wall doubler piece connected to said second top side wall piece, said second top side wall doubler piece being folded around each of said top side wall engaging flaps and wherein said second bottom side wall includes a second bottom side wall piece and a second bottom side wall double piece connected to said second bottom side wall piece;

an elongated floor connected at one end to said first bottom side wall doubler piece and at the other end to said second bottom side wall doubler piece, so that said first and second vertical side trays depend upward from said elongated floor in parallel, spaced-apart relation; and means for separating said elongated floor from said first bottom side wall doubler piece and from said second bottom side wall doubler piece, so that each of said first and second bottom side wall doublers can be folded around the respective ones of said bottom side wall engaging flaps, whereby said first and second vertical side trays can be used as carry out trays.

4. The multiple use shipping and display container of claim 3, wherein said first and second vertical side trays each contain tab means disposed on the top sides and slot means disposed on the bottom sides for aligning and holding another such container stacked thereon.

5. The multiple use shipping and display container of claim 4, wherein said first vertical side panel and said second vertical side panel each include an aperture formed therein for sue as a hand hold.

6. The multiple use shipping and display container of claim 5, formed from a blank of unitary construction.

7. A foldable blank of paperboard material having a plurality of foldably connected panels for erecting a multiple use shipping and display container, comprising:

an elongated floor;

a pair of bottom side wall doubler panels disposed on opposite sides of said elongated floor;

a pair of bottom side wall panels foldably connected to the sides of said bottom side wall doubler panels that are not connected to said elongated floor;

a first and second side panel foldably connected to the sides of said bottom side wall panels that are not connected to said bottom side wall doubler panels for forming vertical side panels;

a first and second end panel extending from opposed ends of each of said side panels for forming end walls of each of said vertical side panels;

a bottom side wall engaging flap extending from a respective end of each of said end panels; and a top side wall panel foldably connected to each end of said first and second side panels that are not connected to said bottom side wall panels for forming top side walls of each of said vertical side panels.

8. The foldable blank of claim 7, further comprising a top side wall engaging flap extending from the opposite end of each of said side end panels that the bottom side wall engaging flap is connected to, and a top side wall doubler panel foldably connected to each said top side wall panels.

9. The foldable blank of claim 8, wherein each bottom side wall engaging flap includes a locking tongue and wherein each side panel includes a slot for engaging said locking tongue.

* * * * *